US006558514B2

(12) United States Patent
Rouhiainen et al.

(10) Patent No.: US 6,558,514 B2
(45) Date of Patent: May 6, 2003

(54) WEB SUPPORT AND TRANSFERRING A PAPER WEB BETWEEN PAPERMACHINE COMPONENTS

(75) Inventors: Paul Rouhiainen, Thunder Bay (CA); Michael John Vander Wielen, Neenah, WI (US); Robert J. Marinack, Oshkosh, WI (US); James R. Benson, Neenah, WI (US)

(73) Assignee: Valmet, Inc., Charlotte, VA (US)

( * ) Notice: Subject to any disclaimer, the term of this patent is extended or adjusted under 35 U.S.C. 154(b) by 112 days.

(21) Appl. No.: 09/760,198

(22) Filed: Jan. 12, 2001

(65) Prior Publication Data

US 2002/0092637 A1 Jul. 18, 2002

(51) Int. Cl.[7] ..... D21F 7/00
(52) U.S. Cl. ..... 162/193; 162/289
(58) Field of Search ..... 162/202, 193, 162/289, 255

(56) References Cited

U.S. PATENT DOCUMENTS 4,321,107 A * 3/1982 Page ..... 162/202
4,501,643 A * 2/1985 Kiuru ..... 162/193
4,566,944 A * 1/1986 Mauranen et al. ..... 162/193
4,904,344 A * 2/1990 Peiffer ..... 162/193
5,738,760 A 4/1998 Svanqvist et al.
5,891,309 A 4/1999 Page et al.
6,004,432 A 12/1999 Page et al.
6,325,896 B1 * 12/2001 Hultcrantz et al. ..... 162/193

OTHER PUBLICATIONS

Calkin, Modern Pulp and Paper Making, (1957), Reinhold Publishing. pp 312 and 313.*

* cited by examiner

*Primary Examiner*—Peter Chin
(74) *Attorney, Agent, or Firm*—Michael E. McKee

(57) ABSTRACT

An apparatus (62) and method for supporting a web (22) of paper being transferred through a region (40) from the surface (26) of one moving component (24) of a papermachine (20) to the surface (30) of a subsequent moving component (28) of the papermachine utilizes an air-permeable sheet (70) and a blowbox (86) or Coanda air knives (38) supported adjacent the air-permeable sheet. The sheet is supportable in a stationary condition across so as to span at least a portion of the papermachine region through which the moving web of paper is transferred and adjacent one side (72) of the web, and the blowbox or Coanda air knives are used to move air away from the side (72) of the air-permeable sheet opposite the web so that as the web is moved through the papermachine region, the web is biased by atmospheric air pressure into contact with the air-permeable sheet and moves in sliding engagement thereal-ong.

48 Claims, 8 Drawing Sheets

WEB SUPPORT AND TRANSFERRING A PAPER WEB BETWEEN PAPERMACHINE COMPONENTS

BACKGROUND OF THE INVENTION

This invention relates generally to papermachines used in the making of paper and relates, more particularly, to the means and methods for supporting a web of paper as the web is moved through the papermachine. The invention addressed herein is particularly relevant in the making of tissue paper (i.e. a lightweight paper grade), but can also be used in the making of any grade of paper within a large range of paper grades.

As a web of paper is moved through a papermachine during production of the paper, the web contacts various surfaces of the papermachine components, such as dryer cylinders, transfer rolls and permeable carrier mediums (e.g. fabrics, wires, or felts), which provide support and stability to the moving web. However, there commonly exists open draws between surfaces of adjacent papermachine components through which the web is required to move without contact from any papermachine component. Such an open draw may, for example, be present between the off-running side of a dryer cylinder and a moving carrier medium or an equivalent surface to which the web is transferred from the cylinder or between the off-running end of a moving carrier medium and the surface of a subsequent transfer roll. Consequently, as the web moves through such an open draw, the web is devoid of any external support which would help stabilize the web. It would be desirable to provide an apparatus for use in a region of a papermachine where such an open draw would otherwise be present and which provides support and stability to the web as it moves through the region.

Accordingly, it is an object of the present invention to provide a new and improved means for supporting a web of paper as the web is moved between adjacent components of a papermachine where there would otherwise exist an open draw through which the web is moved and a method of supporting the web as it is moved between the papermachine components and method of supporting the web as it is moved between the papermachine components.

Another object of the present invention to provide a new and improved means for providing support and stability to a web as it moves through a region of a papermachine wherein no external support has heretofore been provided to the moving web as it moves through the region.

Still another object of the present invention is to provide such a means which reduces the likelihood that the web will pull itself apart (due, for example, to the weight and water content of the web) or experience undesirable movements, such as flutter, as the web is transferred between successive components of a papermachine which could result in a web break or adversely affect the quality of the paper being produced.

Yet another object of the present invention is to provide such a means which helps to confine the movement of the web along an intended path of movement thereby reducing the likelihood of a web break as a result of the web moving out of its intended path of movement.

A further object of the present invention is to provide such a means which is particularly well-suited for supporting a web of tissue paper as the web is moved between adjacent components of a tissue machine where there would otherwise exist a open draw.

One more object of the present invention is to provide such a means which is uncomplicated in construction yet effective in operation.

SUMMARY OF THE INVENTION

This invention resides in an apparatus and method for supporting a web of paper moving through a transfer region of a papermachine through which region the moving web is transferred from the surface of one component of the papermachine to the surface of a subsequent component of the papermachine.

The apparatus includes an air-permeable sheet supportable in a stationary condition across at least a portion of the papermachine region through which the moving web of paper is transferred from one component of the papermachine to a subsequent component of a papermachine and so that as the web is moved through the papermachine region, the web moves along one side of the air-permeable sheet. Also included within the apparatus are means for creating a zone of sub-atmospheric pressure adjacent the side of the air-permeable sheet opposite the web so that as the web is moved through the papermachine region, the web is biased, by air pressure, into contact with the air-permeable sheet and moves in sliding engagement therealong.

The method of the invention includes the steps of positioning the air-permeable sheet in the stationary condition across at least a portion of the papermachine region and then creating a zone of sub-atmospheric pressure adjacent the side of the air-permeable sheet opposite the web of paper so that as the web is moved through the papermachine region, the web is biased, by air pressure, into contact with the air-permeable sheet and moves in sliding engagement therealong.

DETAILED DESCRIPTION OF THE ILLUSTRATED EMBODIMENTS

Figure 1:
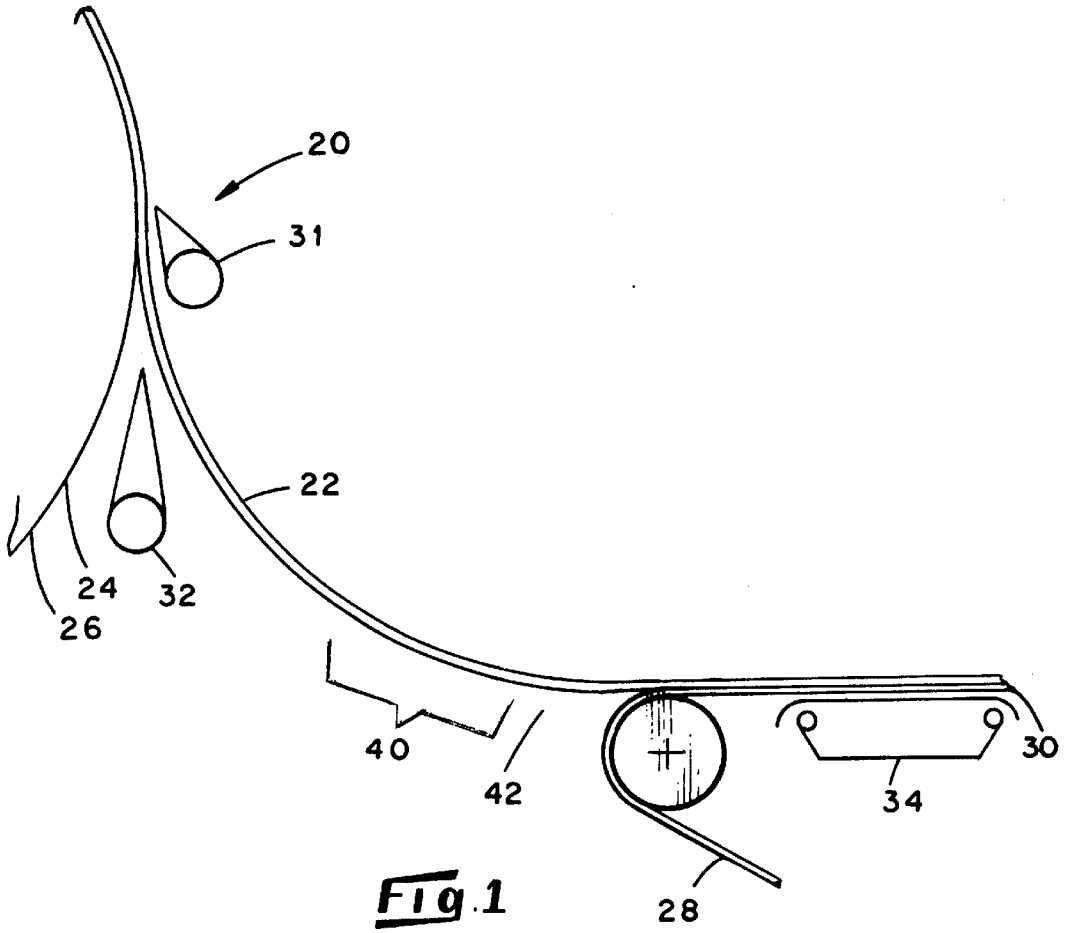
Fig. 1 PRIOR ART
FIG. 1 is a schematic side view of a fragment of a dryer section of one papermachine of the prior art illustrating the unsupported condition of a web of paper as the web is transferred across an open draw between successive components of the papermachine.

Turning now to the drawings in greater detail, there is illustrated in FIG. 1 a dryer section of a papermachine 20 of the prior art (for example, a tissue machine) having components between which a moving web 22 of paper is transferred as the web 22 is moved through the papermachine 20. More specifically, the papermachine 20 includes a rotating drying cylinder 24 having a surface 26 across which the web 22 is conveyed and a roller-driven carrier medium 28 (comprised, for example, of air-permeable fabric) having an upper surface 30 onto which the web 22 is transferred for movement along the machine 20. In the alternative, an air foil support, such as is described in U.S. Pat. No. 5,738,760 (the disclosure of which is incorporated herein by reference), can be substituted for the moving carrier medium.

As used herein, the term "web" refers to a web of paper wherein the paper of the web can be any of a number of paper grades, including tissue paper. Accordingly, the principles of the present invention can be variously applied.

The papermachine 20 depicted in FIG. 1 is a tissue-making machine, and the drying cylinder 24 is known in the art as a Yankee dryer whose surface 26 is steam-heated for the purpose of removing moisture from the web 22 of paper as the web 22 is conveyed across the dryer surface 26. The papermachine 20 is also provided with a creping doctor 32 for removing the web 22 from the cylinder surface 26 at a preselected location therealong while effecting a crinkling of the web 22 as it is removed from the cylinder surface 26. In addition, a skinning doctor 31 is disposed along the dryer surface 26 upstream of the creping doctor 32. To help prevent separation of the web 22 from the carrier medium 28 as the web 22 is conveyed along the upper surface 30 of the carrier medium 28, a blowbox 34 is mounted on the side of the carrier medium 28 opposite the upper surface 30 or, as illustrated in FIG. 1, beneath the upper run of the carrier medium 28.

It can be seen from the FIG. 1 view that there exists within the papermachine 20 a region of movement, generally indicted 40, through which the web 22 is moved as the web 22 is transferred from the surface 26 of the drying cylinder 24 to the surface 30 of the carrier fabric 28. Such a region of movement 40 provides an open draw 42 through which the moving web 22 is out of contact with, and therefore not supported by, any component of the papermachine 20. Although the size (i.e. length) of an open draw at one site in a papermachine can be different than the size of an open draw at another site in a papermachine, it is not uncommon that the size of open draws, like the open draw 42 depicted in FIG. 1, is in the range of between 3.0 feet and 6.0 feet.

The absence of external support applied to the web 22 as the web 22 moves through this open draw 42 increases the likelihood that undesirable movements, such as flutter, will be induced within the web 22 as the web 22 moves through this region 40 which, in turn, can adversely affect the quality of the paper being produced. Moreover, inasmuch as the web 22 may possess a relatively high water content (e.g. which may be as much as forty-five to sixty-five percent) as it leaves the cylinder surface 26, the web 22 could pull itself apart under its own weight as the web 22 moves across this open draw 42.

Figure 1A:
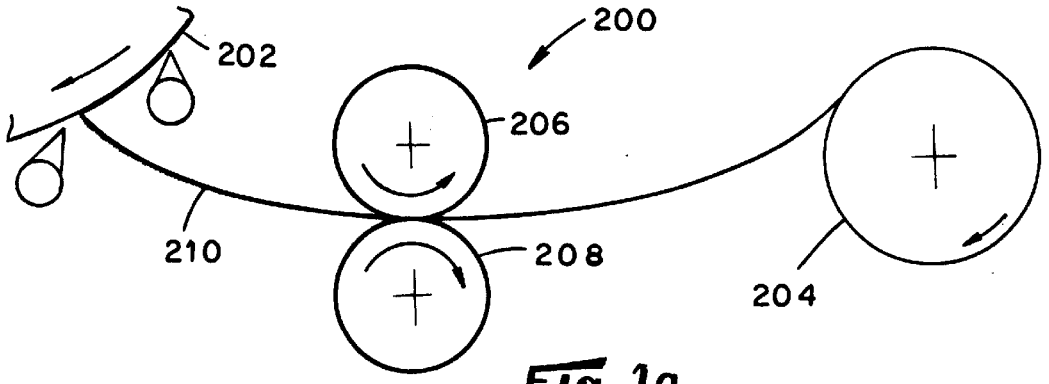
Fig. 1a PRIOR ART
FIG. 1*a* is a schematic side view of a fragment of a dryer section of another papermachine of the prior art illustrating the unsupported condition of another web of paper as the web is transferred between successive components of the papermachine.

There exists other sites within papermachines at which open draws are present between successive papermachine components. For example, there is illustrated in FIG. 1*a* a papermachine 200 having a Yankee dryer 202, a reel-up 204 and a pair of rolls 206, 208. A web 210 which is routed through the papermachine 200 moves in sequence from the surface of the dryer 202 and then through a nip formed between the surfaces of the rolls 206, 208 before being wound about the reel-up 204. It can be seen that in the FIG. 1*a* view that there exists relatively lengthy open draws between (1) the surface of the dryer 202 and the rolls 206, 208 and (2) the rolls 206, 208 and the reel-up 204. In the paragraphs which follow, embodiments of supporting apparatus are described for supporting the web 22 as the web 22 is moved across an open draw like the open draw 42 of the FIG. 1 papermachine 20. It will be understood, however, that supporting apparatus in accordance with the present invention can be used to support a web moving between successive papermachine components at other sites in a papermachine or in other papermachines. Accordingly, the principles of the present invention can be variously applied.

Figure 2:
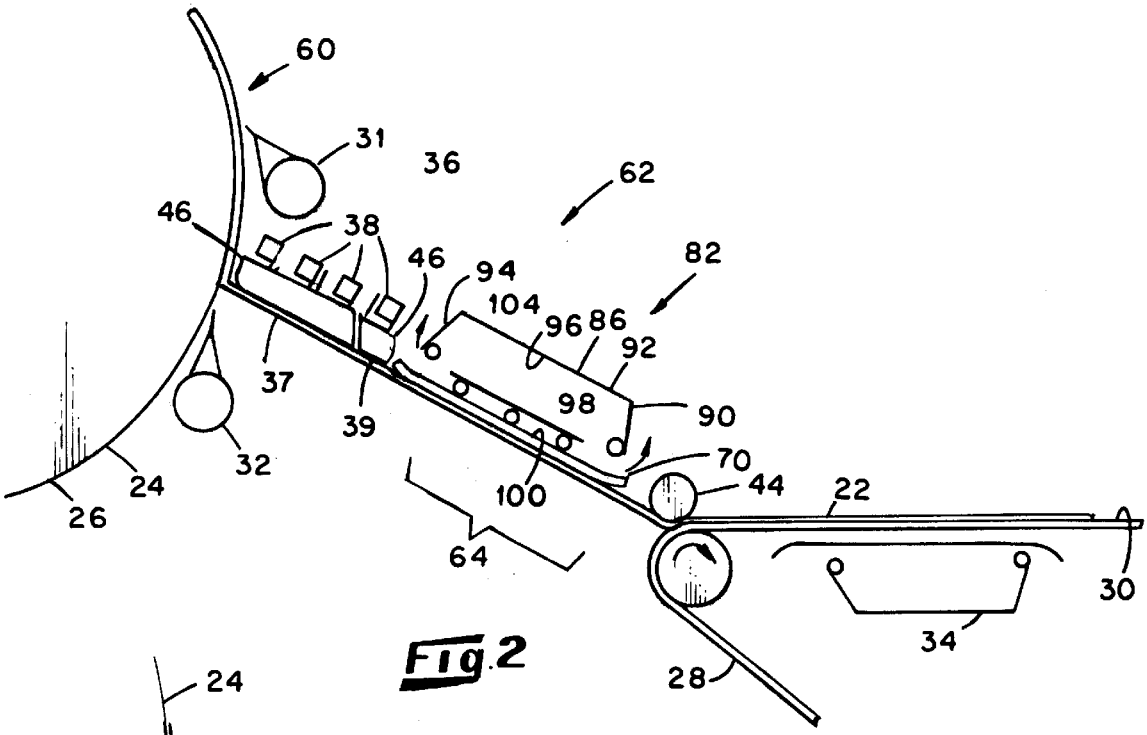
FIG. 2 is a view similar to that of FIG. 1 of a papermachine which has been equipped with an embodiment of a support apparatus of the present invention.

With reference to FIG. 2, there is shown a dryer section of a papermachine 60 (for example, a tissue machine) having components between which a moving web 22 is transferred as the web 22 is moved through the papermachine 60 and wherein the papermachine 60 utilizes an embodiment, generally indicated 62, of an apparatus for supporting the web 22 as the web 22 is transferred between the components. The papermachine 60 is comparable to the papermachine 20 of FIG. 1 in that it includes many of the components, such as a rotating drying cylinder 24, creping doctor 32 and a moving carrier fabric 28, utilized in the FIG. 1 papermachine 20. Accordingly, the components of the FIG. 2 papermachine 60 which are identical to those of the FIG. 1 papermachine 20 bear the same reference numerals. In addition, the FIG. 2 papermachine 60 includes a region of movement, indicated 64, through which the web 22 is moved as the web 22 is transferred between the surface 26 of the drying cylinder 24 and the upper surface 30 of the carrier fabric 28. The support apparatus 62 is supportedly positioned within this region 64 and, as will be apparent herein, acts upon the web 22 in a manner which provides support and stability to the web 22 as the web 22 moves through this region 64. For purposes of smoothing the web 22, and thereby prevent the formation of longitudinal folds therein, a Mount Hope roll 44 is rotatably mounted above the web 22 adjacent the leading edge of the carrier medium 28.

With reference still to FIG. 2, the support apparatus 62 includes an air-permeable sheet 70 which is suitably supported in a stationary condition across the papermachine region 64 so as to span a substantial portion (e.g. at least one-half) of the entire length of the region 64. Furthermore, the sheet 70 is sized to extend across the width of the web 22 as the web 22 is measured between its opposite side edges and is positioned adjacent one side of the moving web 22. During operation of the support apparatus 62, the web 22 is urged upwardly toward and into engagement with the sheet 70 as a result of a pressure differential created on opposite sides of the moving web 22 and wherein the higher pressure is on the side of the web 22 opposite the sheet 70 (i.e. the lower side of the sheet 70). Accordingly, the sheet 70 is positioned adjacent the side of the moving web 22 toward which the web 22 is desired to be urged, i.e. on the low-pressure side of the web 22.

Figure 3:
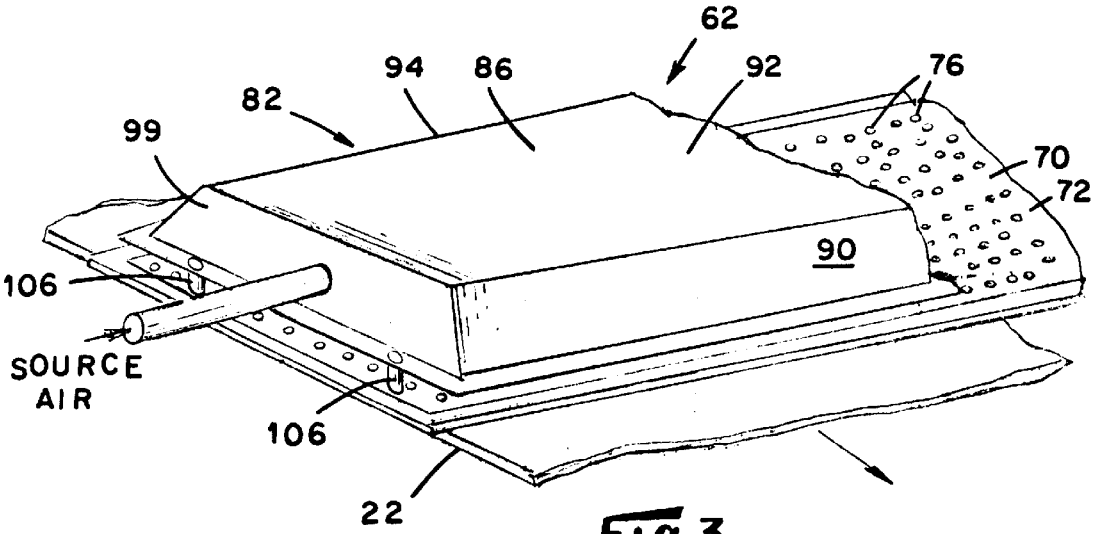
FIG. 3 is a perspective view, shown partially cut-away, away, of the support apparatus of FIG. 2.

In the depicted apparatus 62, the sheet 70 is plate-like in form and has side edges which are arranged in a plane. Furthermore, the sheet 70 is comprised of a rigid sheet steel, although other materials, such as an air-permeable fabric, can be used, and its opposite side faces, indicated 72 and 74 in FIG. 3, are relatively smooth. In addition, the depicted sheet 70 is perforated in that it defines a plurality of through-openings 76 (formed by bores) extending between the side faces 72 and 74. In the depicted sheet 70, each through-opening 76 is 0.25 inches in diameter and the centers of the through-openings 76 (which are arranged in staggered rows along the length of the sheet 70) are 0.5 inches apart. Thus, the through-openings 76 are relatively small in size and are regularly dispersed throughout the side faces 72 and 74. Through-openings of alternative sizes and spacings are, of course, possible.

As used herein, the term "air-permeable" is intended to describe any of a number of materials which are adapted to suitably permit the flow of air therethrough. For example and as mentioned above, the air-permeable sheet 70 could be constructed of a flexible air-permeable fabric material or a plate comprised, for example, of a synthetic resin. Accordingly, the air-permeable material need not itself be rigid, although a flexible material would necessarily have to be supported in a relatively rigid condition (e.g. by way of a rigid frame attached, for example, along the edges of the material) to resist forces expected to be applied to a side face of the sheet during operation of the support apparatus 62. Furthermore, the side face of the air-permeable sheet along which the web 22 is expected to slidably move is preferably smooth to avoid damage to the web 22 by the sheet.

As mentioned earlier, the air-permeable sheet 70 is positioned across so as to substantially span the length of the papermachine region 64. In this connection, the sheet 70 has a leading edge 78 across which the moving web 22 first comes into contact with the sheet and a trailing edge 80 across which the moving web 22 moves out of contact with the sheet 70, and each of the leading and trailing edges 78, 80 is positioned in relatively close proximity (e.g. within about 1.0 feet) to the closest papermachine component disposed upstream or downstream of the corresponding edge 78 or 80. Preferably, however, each of the leading or trailing edges 78 or 80 are as close to the closest papermachine component disposed upstream or downstream of the corresponding edge 78 or 80 as is required by the specific application. If desired, the leading edge 78 or the trailing edge 80 may be upturned (i.e. provided with an arcuate shape) as shown in FIGS. 2 and 4 to reduce any likelihood that the web 22 would catch or tear as it moves across the leading or trailing edge.

Figure 4:
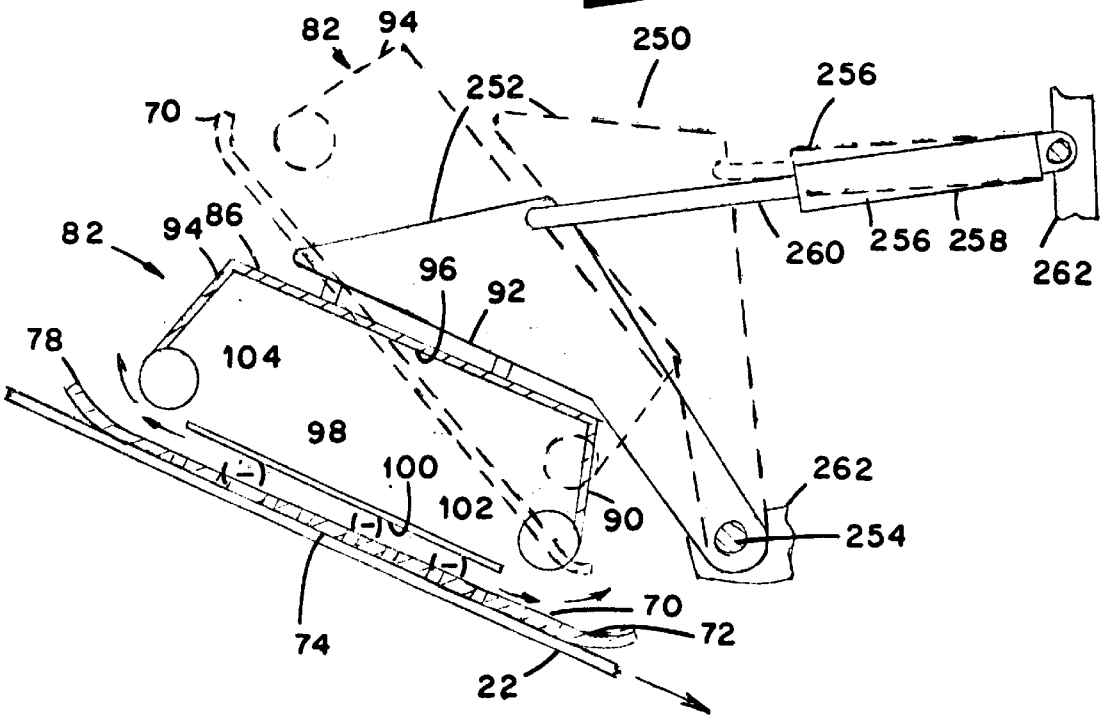
FIG. 4 is a view of another fragment of the support apparatus as illustrated in FIG. 2 but drawn to a slightly larger scale.

With reference to FIGS. 2–4, the support apparatus 62 also includes means, generally indicated 82, for directing air from a source away from the side of the air-permeable sheet 70 opposite the web 22 so that as the web 22 is moved through the papermachine region 64, the web 22 is biased into contact with and slidably moves along the length of the sheet 70. In the depicted apparatus 62, the air-directing means 82 includes a blowbox 86 situated adjacent (i.e. above) the side face 72 of the sheet 70 for creating a zone of low pressure (i.e. sub-atmospheric pressure) adjacent the side face 72 of the air-permeable sheet 70 so that the web 22 is drawn against the lower surface of the sheet 70 by way of the through-openings provided in the sheet 70.

To this end, the blowbox section 86 includes a series of walls 90, 92, 94 which are joined together to provide a box-like interior 96 for the blowbox 86 and also includes a partition 98 which is positioned between so as to separate the blowbox interior 96 from the sheet 70. Each of the walls and partition 98 of the blowbox section 86 are constructed, for example, of appropriately-shaped sheet metal, and the interior 96 is sized to span substantially the entire width of the sheet 70. In addition, the opposite ends of the interior are capped with end walls 99 (only one shown in FIG. 3) having lower edges which terminate in close proximity to the sheet 70. The blowbox partition 98 is arranged substantially parallel to the side face 72 of the sheet 70 so that a narrow air space 100 is provided between the partition 98 and the side face 72 of the sheet 70. Nozzles 102 and 104 are disposed at the opposite (longitudinal) ends of the blowbox interior 96 for extending across the machine 60 and for receiving pressurized air from an air supply (e.g. a high-pressure industrial fan) and for discharging the air through elongated slots formed along the length of the nozzles 102 and 104.

With reference still to FIG. 3, the sheet 70 is suspended from the walls of the blowbox 86 by way of suitable strut members 106 so that the support apparatus can be supported as a single unitary unit from a frame (not shown) situated above the papermachine region 64. If desired, the blowbox 86 can be supported by the frame for movement into and out of the papermachine region 64 to facilitate the servicing of various ones of the papermachine components, such as the creping doctor 32. In addition, the provision of the strut members 106 which extend between the blowbox 86 and the sheet 70 maintain a constant spacing between the blowbox partition 98 and the sheet 70. In practice, a spacing of $^{11}/_{16}$ inches (0.6875 inches) has been found to be a suitable distance between the partition 98 and the sheet 70.

The operating principles of blowboxes are described in U.S. Pat. No. 4,551,203 (the disclosure of which is incorporated herein by reference) so that a detailed description of such principles are not believed to be necessary. Suffice it to say that as streams of air are discharged from the nozzles 102 and 104 in directions generally away from the side face 72 of the air-permeable sheet 70, a vacuum zone (i.e. a region of sub-atmospheric pressure) is created within the narrow air space 100. The resulting difference in air pressure which exists between the air space 100 (disposed adjacent the sheet side face 72) and the air space disposed adjacent the opposite, or lower, side face 74 draws the air from the lower side face 74 of the sheet 70 through the through-openings 76 to the air space 100 so that a pressure differential is created on opposite sides of the web 22 and so that the greater pressure (or more specifically, atmospheric pressure) exists on the side of the web 22 opposite the sheet 70. Consequently, the air pressure which exists on the high-pressure side of the web 22 (i.e. the lower surface as depicted in FIG. 4) urges the web 22 toward and thereby biases the web 22 into contact with the lower side face 74 of the sheet 70. The web 22 may be required to be tensioned across the papermachine region 64 so that the web 22 is positioned close enough to the sheet 70 so that the web 22 is lifted into contact with the sheet 70 by the air pressure which exists on the lower side of the web 22. In any event, it has been found that as long as the pressure differential created on the opposite sides of the web 22 by the blowbox 86 is strong enough to hold the web 22 into contact with the sheet 70, the movement of the web 22 along the stationary sheet 70 does not cause the web 22 to fall from the sheet 70.

While the blowbox section 86 has been described above as having end walls 99 which terminate in close proximity to the sheet 70, an alternative blowbox section can possess end walls which are equipped with edge nozzles which extend along the length thereof for discharging air from a source and away from the air-permeable sheet 70 to thereby aid in the lowering of the air pressure between the partition 98 and the sheet 70 to sub-atmospheric conditions. In such a blowbox embodiment, therefore, the region of sub-atmospheric conditions between the partition 98 and the sheet 70 are bordered by the edge nozzles and the cross-machine nozzles 102 and 104.

The aforedescribed biasing of the web 22 into contact with the side face 74 of the sheet 70 confines the movement of the web 22 along the substantially linear contour of the depicted sheet and thereby enables the sheet 70 to provide a support backing for the web 22 as the web 22 is moved through the papermachine region 64. With the moving web 22 drawn into contact with the side face 74 in this manner, the web 22 is not supported in a suspended condition between the cylinder 24 and carrier medium 28 (as is the case with the FIG. 1 papermachine 20), and the web 22 is less likely to pull itself apart under the influence of its own weight or experience undesirable movements, such as flutter, as the web 22 is moved through the region 64. Furthermore, with the movement of the web 22 substantially confined along the linear contour of the sheet 70 by the blowbox section 86, the web 22 is less likely to break or otherwise experience damage as a consequence of the web 22 shifting out of its desired path of movement. Consequently, the biasing of the moving web 22 into contact with the side face 74 of the sheet 70 for sliding movement therealong provides support and stability to the web 22 that the web 22 would not otherwise possess if a relatively large open draw existed in the papermachine region 64 between the drying cylinder 24 and the carrier fabric 28.

As mentioned earlier, the air-permeable sheet 70, if rigid, can be suitably be supported for operation across the region 64 by means of a rigid frame attached, for example, along the edges of the sheet 70. In the alternative and as exemplified in FIG. 4, the entire support apparatus 62 could be pivotally supported across the region 64 by means of a support system 250 for movement between a position illustrated in solid lines in FIG. 4 for apparatus operation and a position illustrated in phantom in FIG. 4 to permit, for example, the apparatus 64 to be serviced. The depicted support system 250 is provided with a frame 252 which is rigidly attached to the apparatus 62 and is pivotally attached to a stationary structure, such as the frame, indicated 262, of the papermachine with a pivot pin 254. A cylinder assembly 256 having a cylinder 258 and a ram 260 is connected between the papermachine frame 262 and the frame 252 so that actuation of the cylinder assembly 256 pivotally moves the apparatus 62 between the FIG. 4 solid-line and phantom-line positions.

Figure 2A:
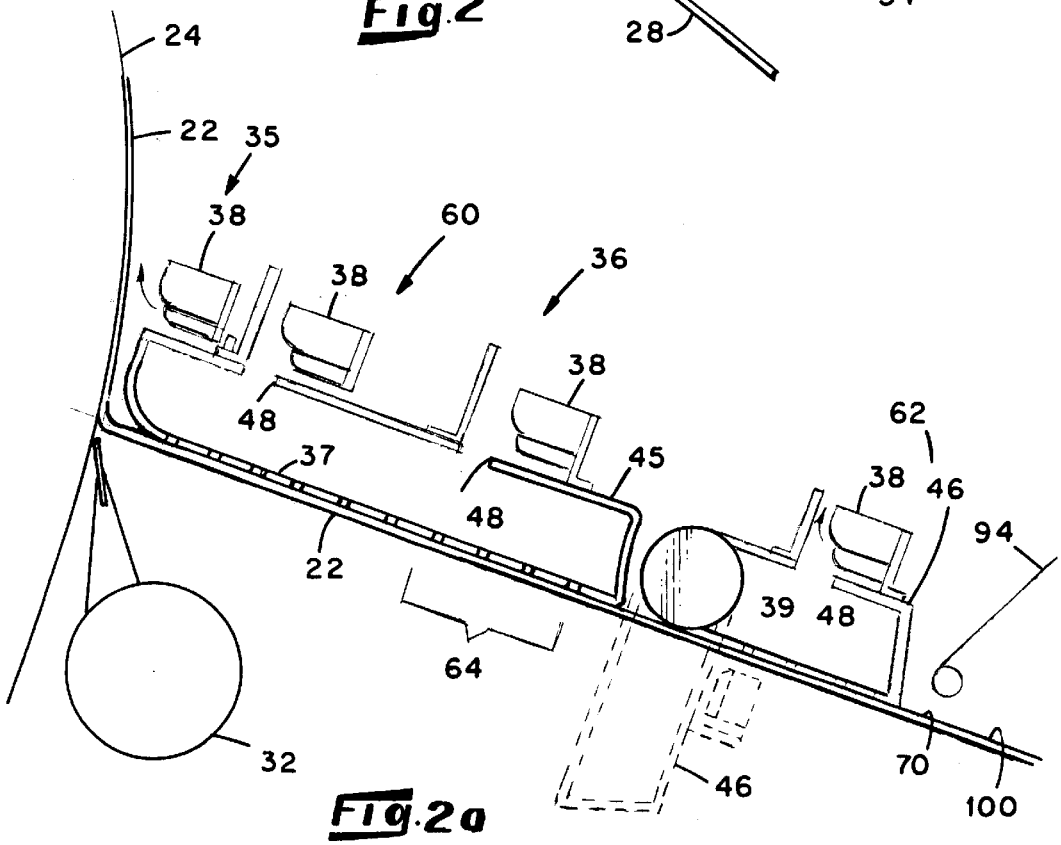
FIG. 2*a* is a longitudinal cross-sectional view of one fragment of the embodiment of FIG. 2 but drawn to a slightly larger scale.

With reference to again to FIG. 2 and to FIG. 2*a*, there is disposed within the region of movement 64 another support apparatus 36 disposed upstream of the support apparatus 62 for acting upon the web 22 in a manner which provides support and stability to the web 22 as it moves along the apparatus 36. The support apparatus 36 includes a pair of box-like compartments 45, 46 having bottom panels in the form of an air-permeable sheet, or foil, 37 or 39 which are supported so as to span the width of the web 22 of paper and means, generally indicated 35, for moving, or drawing, air from the side of the sheet 37 or 39 opposite the web 22 so that as the web 22 is moved along the portion of the region 64 spanned by the support apparatus 36, the web 22 is biased (upwardly) into contact with and slidably moves along the length of the sheets 37 and 39. As best shown in FIG. 2*a*, the upstream edge of the sheet 37 is disposed in close proximity to the surface of the dryer 24, while the upstream edge of the sheet 39 is disposed in close proximity to the downstream edge of the sheet 37. Each sheet 37 or 39 is provided with a plurality of through-openings which permit the passage of air between the opposite sides of the sheet 37 or 39, and the air-directing means 35 includes a plurality of Coanda air knives 38 mounted atop the compartments 45, 46 and disposed adjacent upwardly-directed openings 48 provided in the top panel of the compartments 45, 46 so that the air knives 38 span the entire width of the compartments 45, 46.

The Coanda air knives 38 are adapted to receive compressed air (e.g. in the range of between 30 and 60 psig) from a compressor and discharge the pressurized air from outlets provided in the knives 38 so that the air which is directed out of the knives 38 exit the knife outlets at about a right angle to the air-permeable sheets 37 and 39. In accordance with the known principles of the Coanda effect, the air which is forced to exit the knives 38 entrains, and thereby draws, air from the interiors of the compartments 45 and 46 by way of the openings 48 and thereby creates a region of sub-atmospheric pressure within the interiors of the compartments 45 and 46. The creation of the sub-atmospheric pressure within the compartments 45 and 46 renders the atmospheric pressure on the underside of the web 22 higher than that on the upper side of the sheets 37 and 39 so that the web 22 is biased by the greater air pressure upwardly into contact with the underside of the sheets 37 and 39 for sliding movement therealong. This biasing of the web 22 into contact with the underside of the sheets 37 and 39 as the web 22 moves therealong enables the sheets 37 and 39 to provide a support backing for the web 22.

In addition, the compartment 45 is hingedly secured to appropriate support means adjacent the trailing edge of the sheet 37 so that the compartment 45 can be pivoted between a position illustrated in solid lines in FIG. 2*a* and a position illustrated in phantom in FIG. 2*a*. Therefore, the compartment 46 acts as a trap door (or a skinning broke bombay door) providing an opening through which the web 22 could be routed from the skinning doctor 31 to facilitate the servicing of various ones (e.g. the creping doctor 32) of the papermachine components.

While the papermachine 60 of FIGS. 2 and 2*a* has been shown and described as including two types of support apparatus for supporting a web 22 as the web is moved across the region of movement 64, one type of which includes a blowbox section 86 and an air-permeable sheet 70 and the other of which includes at least one compartment 45 or 46 equipped with a Coanda air knife 38, a papermachine region may employ only one of these types of support apparatus for supporting the web as the web is moved thereacross. The decision to employ one type of support apparatus over the other type can depend upon space constraints or the desired level of control over the sub-atmospheric condition which is created on the side of the air-permeable sheet opposite the web. In particular, the compartment/air knife arrangement can be designed to fit across an open draw of relatively small length and the level of the sub-atmospheric conditions created on the side of the air-permeable sheet can be easily and precisely controlled with a compartment/air knife arrangement by, for example, adjusting the size of the compartment openings 48 (FIG. 2*a*). Along the same lines, the level of sub-atmospheric pressure on the side of the air-permeable sheet opposite the web 22 can be controlled easier and in a more precise manner by using air knives (or blowboxes) instead of, for example, vacuum pumps and suction boxes to accomplish a similar purpose.

Figure 5:
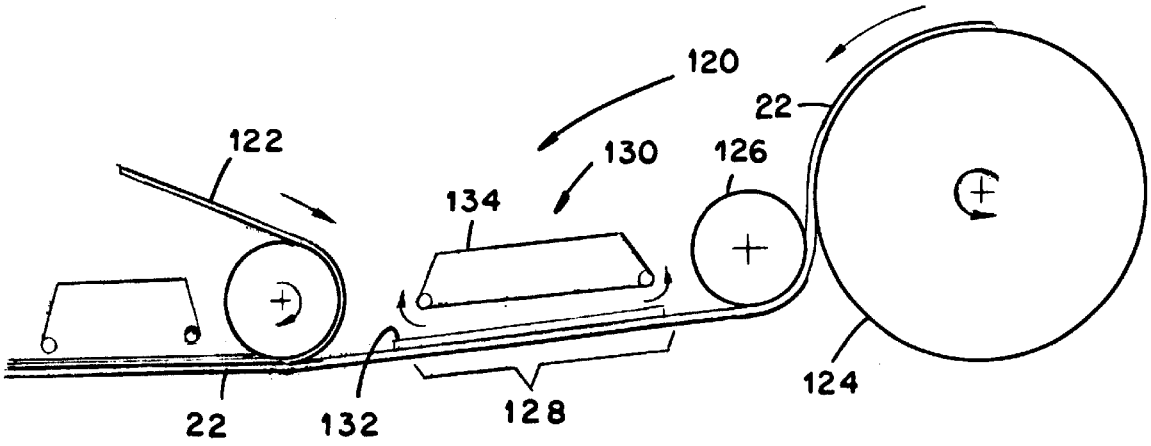
FIG. 5 is a schematic side view of another section of a papermachine within which another embodiment of the support apparatus of the present invention is incorporated.
Figure 6:
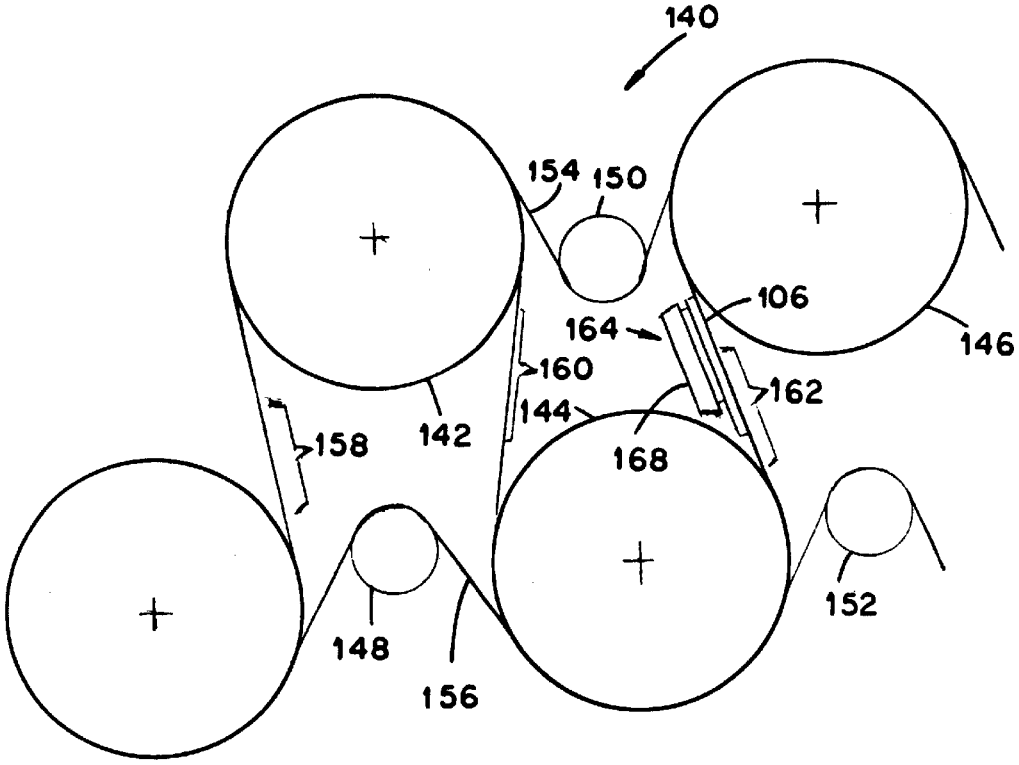
FIG. 6 is a schematic side view of a press section of a papermachine within which still another embodiment of the support apparatus of the present invention is incorporated.

With reference to FIGS. 5 and 6, there are shown alternative papermachine regions within which a support apparatus can be advantageously used to support a web 22 of paper moving through the regions. For example, there is shown in FIG. 5 a section of a papermachine 120 including a roller-driven carrier medium 122, a dryer cylinder 124 and a transfer roll 126 across which a web 22 of paper is moved as the web 22 is conveyed through the papermachine 120. It can be seen in the FIG. 5 view that a transfer region, indicated 128, exists between the surfaces of the carrier medium 122 and the roll 126 which would otherwise provide an open draw across which the web 22 would be required to move without any means of external support. To provide support across the region 128, however, a support apparatus 130 embodying the principles of the present invention is positioned within the region 128 and supported in a stationary condition above the web 22.

More specifically, the support apparatus 130 includes an air-permeable sheet 132 supported in a stationary condition across so as to substantially span the papermachine transfer region 128 and so that as the web 22 of paper is moved through the papermachine region 128, the web 22 moves along one (i.e. the lower) side of the air-permeable sheet 132. In addition, a blowbox 134 is disposed above the air-permeable sheet 132 for directing source air away from the upper side of the air-permeable sheet 132 so that as the web 22 is moved through the papermachine region 128, the web 22 is biased into contact with the air-permeable sheet 132 and moves in sliding engagement therewith through the region 128.

Similarly, there is shown in FIG. 6 a double-felted dryer section of a papermachine 140 including a series of steam-heated drying cylinders 142, 144 and 146 across which a web 22 of paper is conveyed and a series of transfer rolls 148, 150 and 152 across which press fabrics 152 and 156 are conveyed for the purpose of squeezing the web 22 against the surfaces of the corresponding cylinders and thereby squeeze moisture and water from the web 22. It can be seen that within the dryer section of this papermachine 140 there exists a plurality of regions, such as those indicated 158, 160 and 162, between the surfaces of successive drying cylinders and across which the web 22 is conveyed while out of contact with any component of the papermachine 140.

To provide support and stability to the web 22 as it is moved across one of these regions, such as the region indicated 162, a support apparatus 164 including an air-permeable sheet 166 and a blowbox 168 can be positioned across the region in the manner shown in FIG. 6. In particular, the air-permeable sheet 166 is supportable in a stationary condition across so as to substantially span the papermachine region 162 so that as the web 22 is moved through the region 162, the web 22 is moved along one side of the sheet 166 (i.e. the left side of the sheet 166 as shown in FIG. 6). During operation of the support apparatus 164, the blowbox 168 directs air from a source away from the side of the sheet 166 opposite the web 22 so that as the web 22 is moved through the papermachine region 162, the web 22 is biased into contact with the sheet 166 and moves in sliding engagement therealong. Instead of an air-permeable sheet 166 and blowbox 168 which spans the full width of the web 22, a sheet and blowbox arrangement can be utilized which is employed along a preselected region (e.g. along an edge region) of the web 22 for biasing a preselected region (e.g. an edge region) of the web 22 against the underside of the air-permeable sheet.

Figure 7:
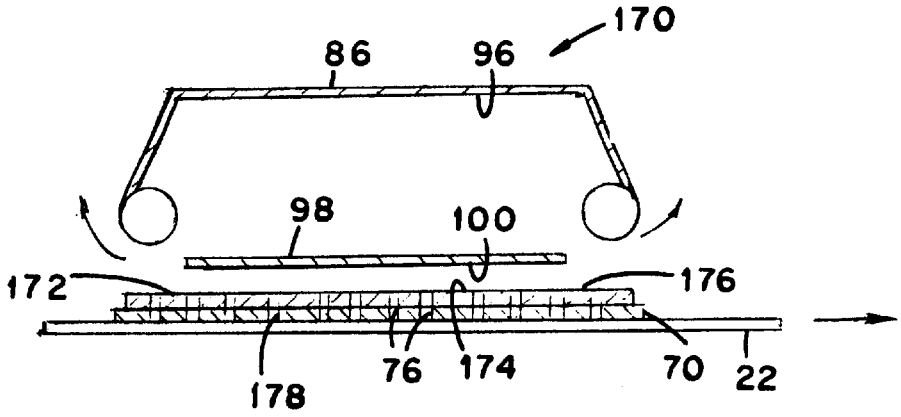
FIG. 7 is a schematic side view like that of FIG. 4 of yet another embodiment of the support apparatus of the present invention.
Figure 8:
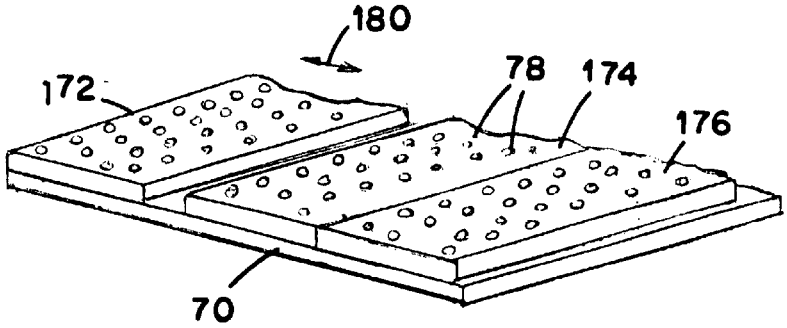
FIG. 8 is a fragmentary perspective view of the air-permeable sheet and control plates of the FIG. 7 embodiment.

With reference to FIG. 7, there is shown a support apparatus 170 including the components of the support apparatus 62 of FIG. 4 with the addition of a series of three perforated control plates 172, 174 and 176 which are positioned upon the upper surface (i.e. upper side face 72) of the air-permeable sheet 70 and are releasably secured to the sheet 70 along the side edges thereof. (The components of the FIG. 7 support apparatus 170 which are identical to those of the FIG. 4 support apparatus 62 accordingly bear the same reference numerals.) As best shown in FIG. 8, the control plates 172, 174 and 176 define through-openings 178 which are positionable in registry with the through-openings 76 of the underlying sheet 70 yet are capable of being shifted forwardly or rearwardly (relative to the direction of web movement) along the length of the underlying sheet 70 so that the through-openings 178 are movable into or out of registry with the underlying openings 76. By moving the plates 172, 174 and 176 forwardly or rearwardly along the sheet 70 (in one of the directions indicated by the arrow 180) between a position (as illustrated in FIG. 7) at which the through-openings 178 and 76 are positioned in registry with one another so that the underlying through-openings 76 are unobstructed (and thereby fully open) and an alternative position at which the through-openings 76 are either partially or fully obstructed (i.e. closed) by the plates 172, 174 and 176, the exposure of the web 22 to the sub-atmospheric condition of the spacing 100 can be controlled, thereby permitting control to be had over the biasing strength exerted upon the web 22.

Moreover, by selectively moving the plates 172, 174 and 176 independently of one another to alternative positions along the sheet 70 permits the biasing strength exerted upon the web 22 to be controlled in selected areas of the length of the sheet 70. Such control, for example, can be utilized to control the biasing strength exerted upon the web 22 along only the side edges of the web 22. The capacity to control the biasing strength exerted upon the web 22 with the plates 172, 174 and 176 can be particularly useful to adapt the support apparatus 62 to support paper webs of different weight or water content.

Figure 9:
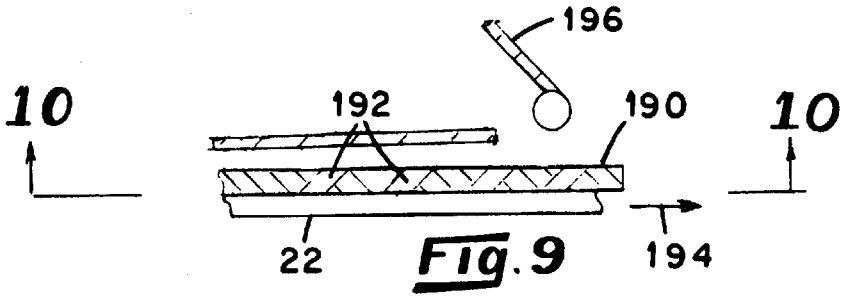
FIG. 9 is a longitudinal cross-sectional view of a fragment of an alternative embodiment of a support apparatus of the present invention.
Figure 10:
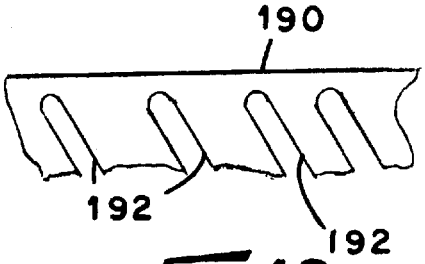
FIG. 10 is a plan view of the embodiment of FIG. 9 as seen along line 10—10 in FIG. 9.

It will be understood that numerous modifications and substitutions can be had to the aforedescribed embodiments without departing from the spirit of the invention. For example, although the air-permeable sheets 70, 37 and 39 of the support apparatus embodiments of FIGS. 2 and 2*a* have been shown and described as including through-openings which are formed with bores having longitudinal axes which are normal to the surface of the corresponding sheet, an alternative air-permeable sheet can possess alternatively-formed air passageways. For example, there is shown in FIGS. 9 and 10 an air-permeable sheet 190 having through-openings 192 which are provided by slot-like openings whose walls are arranged at an oblique angle with respect to the direction of travel of the web 22 therealong, wherein the direction of web travel is indicted by the arrow 194. Furthermore and as best shown in 10, the transversely-extending edges of the through-openings 192 are canted forwardly of the sheet 190 relative to the nearest side edge of the sheet 190. With the walls and edges of the through-openings 192 arranged in this manner, the biasing effect of the air pressure differential induced on opposite sides of the web 22 by suitable air-directing means, such as the blowbox 196 of FIG. 9, effects a desirable cross-stretching of the web 22 with force vectors having components directed both rearwardly of the sheet 190 and outwardly toward the nearest side edges of the web 22.

Further still, the web of paper with which a support apparatus in accordance with this invention can be used can possess any of a number of paper grades, such as flat grade sheet, as well as tissue paper.

In yet still another aspect of the present invention, there is provided an apparatus and method for providing support to a web of paper over an open draw in a papermachine employing one or more air foils with a multiplicity of overlapping plates defining air injection gaps therebetween. In this connection and with reference to FIGS. 11–14, there is illustrated schematically such an apparatus and its various parts including means for supplying relatively low pressure injection air to the air injection gaps as described in detail below.

Figure 11:
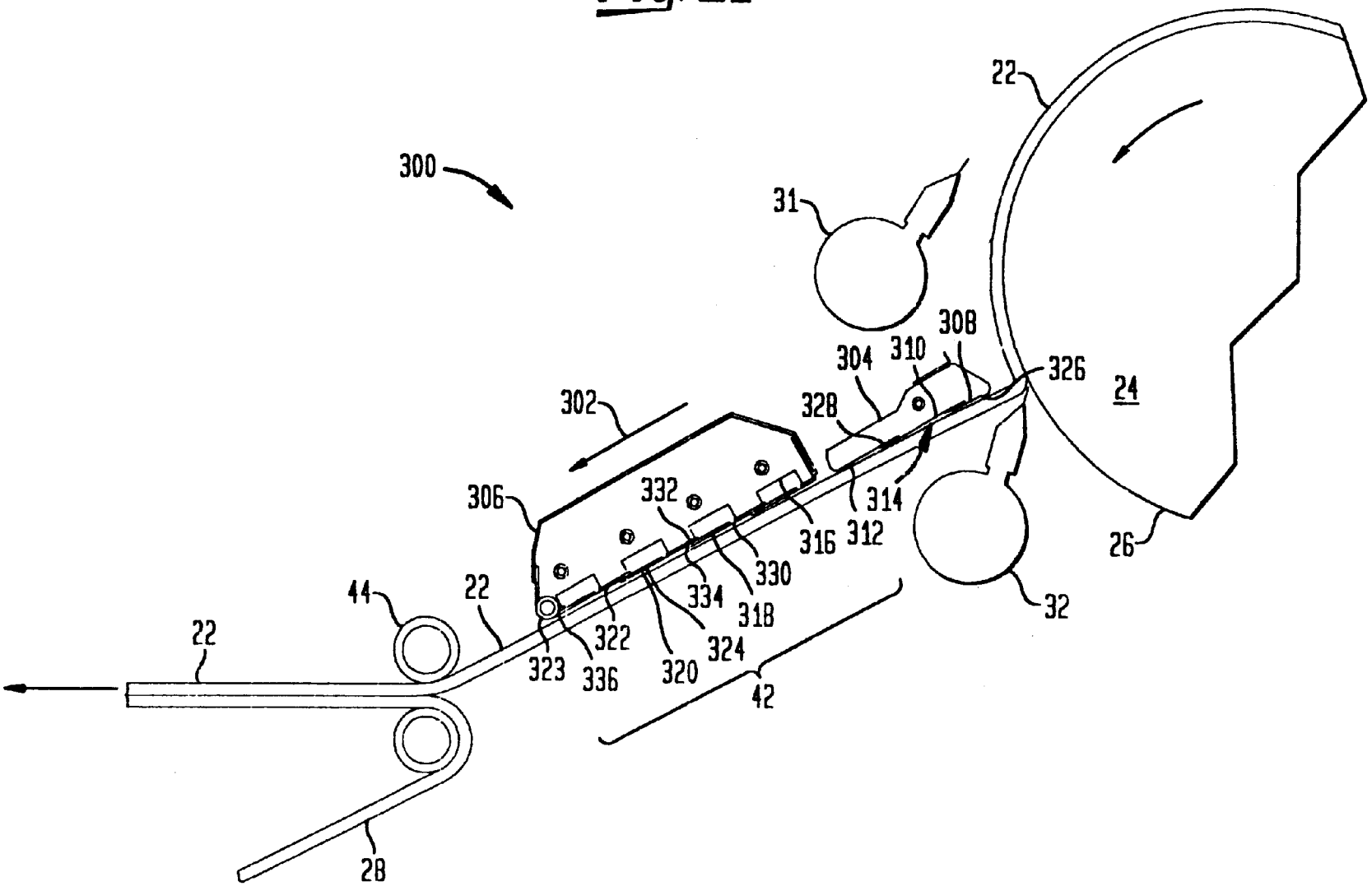
FIG. 11 is a view similar to that of FIG. 1 of a papermachine which has been equipped with still yet another embodiment of a support apparatus of the present invention.

With reference to FIG. 11, which is a schematic side view of a fragment of a dryer section of a papermachine, there is shown a region 300 of a papermaking machine through which a web 22 of paper is transferred from the surface 26 of Yankee dryer 24 to a carrier fabric 28 over an open draw 42 in the direction indicated by arrow 302. As noted in connection with FIG. 1, wherein identical numerals indicate similar parts, web 22 is not supported over the open draw and may be subject to damage at high production speeds due to flutter and so forth.

Creping doctor 32 crepes web 22 from the drying surface 26 during typical operation whereas skinning doctor 31 may be employed for this purpose sporadically during maintenance on the papermachine.

There is provided a first airfoil 304 and a second airfoil 306 in order to stabilize the transfer of web 22 from surface 26 to fabric 28. The airfoil 304 has three step portions 308, 310 and 312 defining its lower surface 314 which is a substantially continuous surface while the second airfoil 306 has five step portions 316, 318, 320, 322 and 323 defining its lower surface 324 which is likewise a substantially continuous and generally planar surface. Stepped surfaces 314, 324 provide support to web 22 during transfer over the open draw 42. Without being bound by any theory, it is believed that the moving web 22 entrains air from between the web and the airfoils, thereby creating relatively low pressure or vacuum (e.g. sub-atmospheric pressure) between the web and foil which operates to support the web. It has been found in accordance with the present invention that it is advantageous to inject air at a relatively low pressure between web 22 and a support surface, such as surface 314 or 324 in order to stabilize the web. In this respect, there is injected into gaps between step portions of the support surfaces 314, 324, injection air at a gauge pressure of from 0.1 to about 40 inches of water to stabilize the system.

In the embodiment of FIGS. 11–14, airfoil 304 has a first gap 326 defined between the step portions 308 and 310 and a second gap 328 defined between step portions 310 and 312. Airfoil 306 is provided with a first gap 330 between step portions 316 and 318, a second gap 332 between step portions 318, 320 as well as a third gap 334 between step portions 320 and 322 and a fourth gap 336 between step portions 322 and 323.

Figure 12:
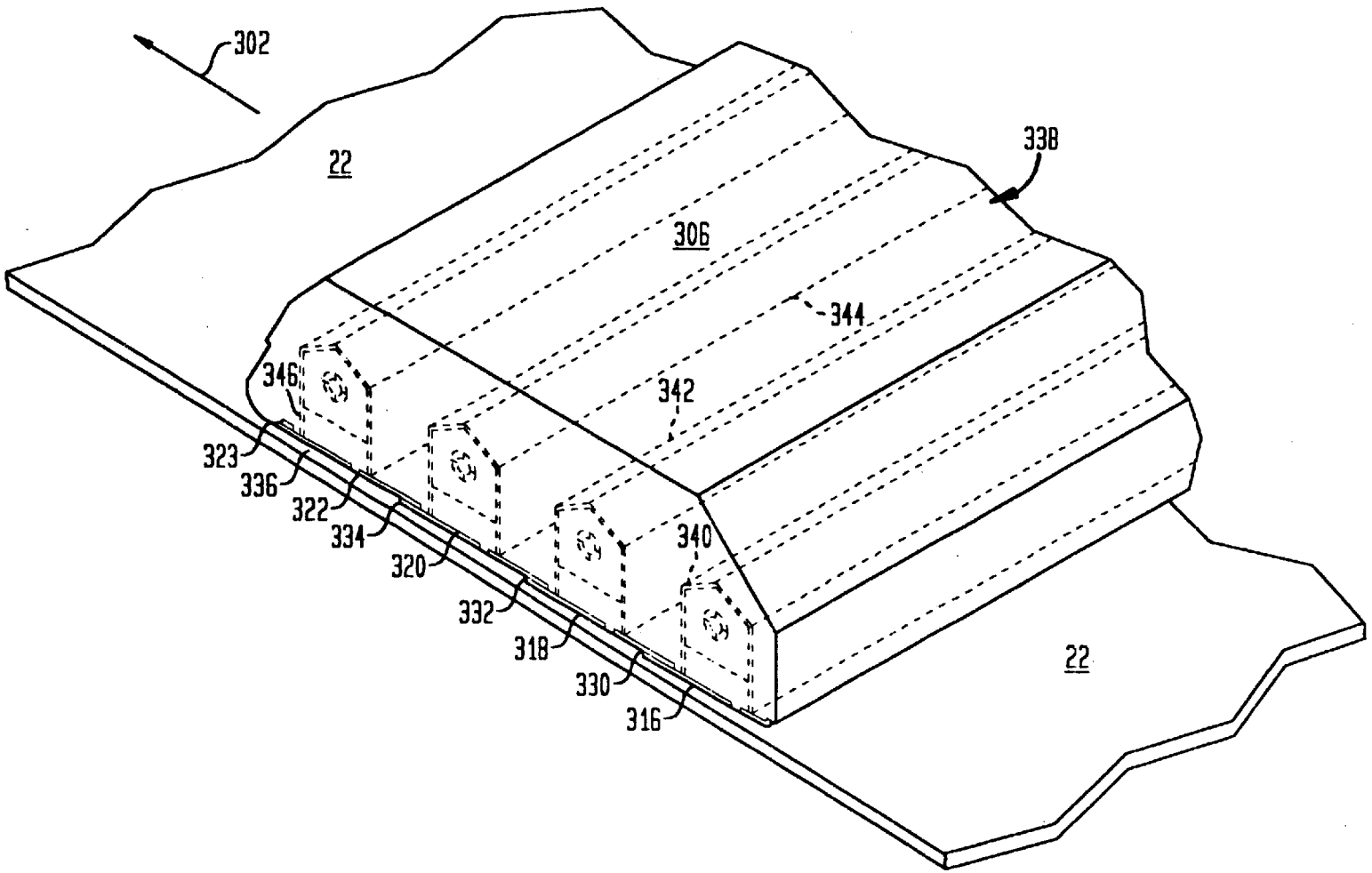
FIG. 12 is a partial perspective view of a portion of the support apparatus embodiment of FIG. 11.

FIG. 12 is a schematic view in perspective showing airfoil 306 of FIG. 11 oriented atop web 22 as the web travels along direction 302. Web 22 travels along lower surface 324 which includes the various step portions 316–323 as shown. The step portions are supported by a housing 338 and may be integrally formed therewith, for example, if the foil is cast or may be fabricated in any suitable manner as is appreciated by one of skill in the art. The housing also includes a plurality of air manifolds indicated schematically at 340–346. Each manifold is independent of the other, that is, not interconnected so that the pressure supplied to each gap 330, 332, 334 and 336 is independently adjustable. This arrangement provides for enhanced control of the air supply to each opening. Thus, manifold 340 supplies air to gap 330, manifold 342 supplies air to gap 332, and so forth.

Figure 13:
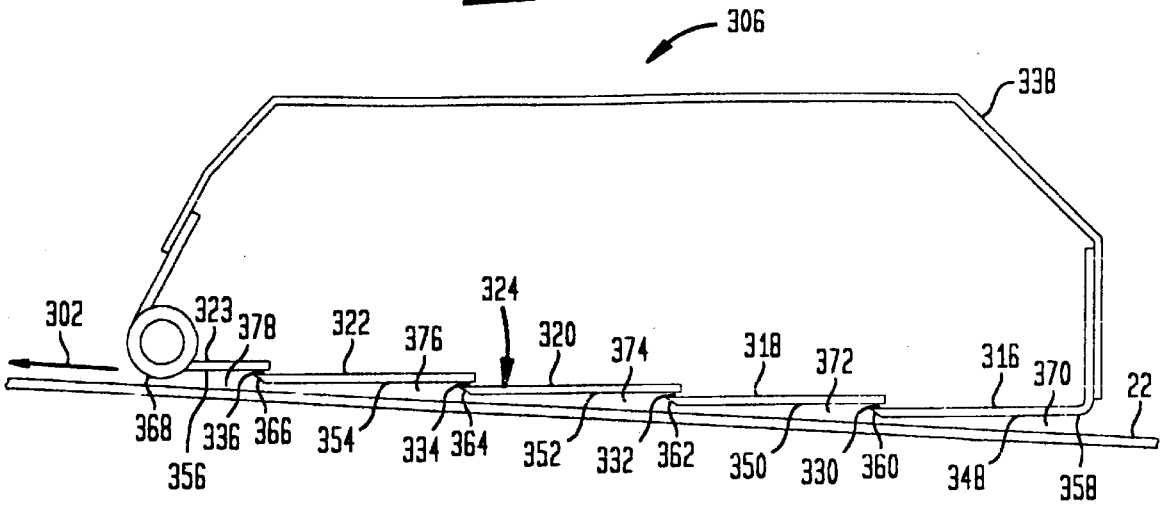
FIG. 13 is a schematic partial side view in cross section illustrating the air foil of FIG. 12.
Figure 14:
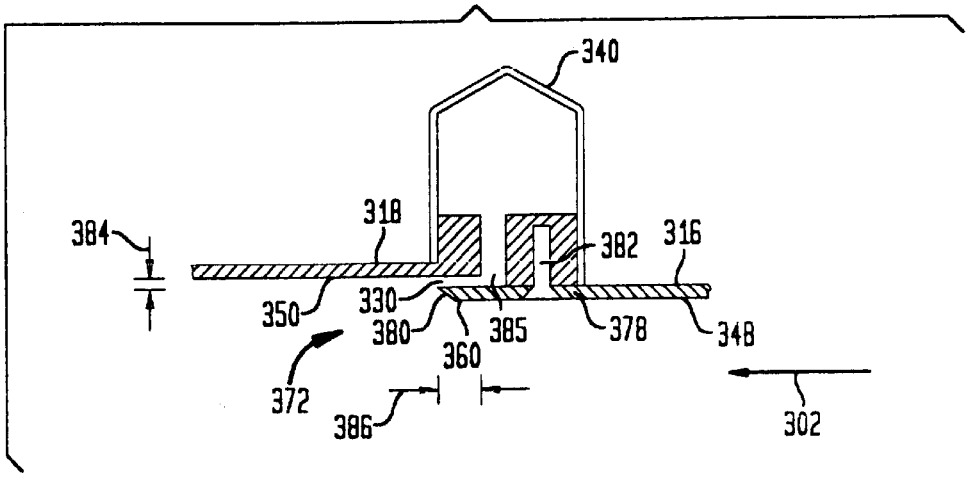
FIG. 14 is a schematic partial view in elevation and cross section of an air gap of the air foil of FIG. 13.

The construction and operation of foils 304, 306 is further appreciated by consideration of FIGS. 13 and 14. FIG. 13 is a schematic partial side view of foil 306 wherein it is shown housing 338 and surface 324 with various components. Surface 324 includes a plate 348 defined by portion 316, a plate 350 defined by portion 318, a plate 352 defined by portion 320, a plate 354 defined by portion 322 and a plate 356 defined by portion 323. The plates 348–356 as well as surface 324 are generally planar as shown in FIGS. 11–14 and overlap with each other as is best shown in FIGS. 11–14 and overlap with each other as is best seen in FIG. 14. The plates can be unitary or segmented, but are preferably segmented. In operation, web 22 is in sliding engagement or near engagement with foil 306 at only its most outwardly protruding portions, for example, at lead portion 358, plate junction 360, plate junction 362, plate junction 364, plate 364, plate junction 366 and trailing portion 368. There is thus a plurality of cavities 370, 372, 374, 376 and 378 between web 22 and surface 324, each of which is supplied with air under a positive gauge pressure from manifolds 340–346 through gaps 330–336. The gaps and associated structure are preferably identical or nearly identical in configuration and have the features shown schematically in FIG. 14.

FIG. 14 is a schematic partial view in elevation and cross section of gap 330 of foil 306 of FIGS. 11–14 showing the gap and its associated manifold 340. Manifold 340 has a plurality of walls to contain injection air generally under a positive gauge pressure of from 0.1 to 40 inches of water in communication with gap 330 through a channel 385 such that air is gently injected through gap 330 into cavity 372 between web 22 and surface 324 along the direction of travel 302 in region 300 of the papermachine. Plate 348 is a segmented plate including a knife edge portion or strip 378 provided a with a beveled or chamfered edge 380 disposed in junction 360 and secured by a plurality of screws such as screws 382. Thus, when web 22 contacts junction 360, the chamfered edge 380 will not snag or damage the product since it is tapered in the direction of travel of the web. In general, the gap has an opening 384 of length 386. Opening 384 is generally from about 0.05 to about 2 mm whereas overlap length 386 may be about 5 mm. It is further noted that the opening of the gap 330 is generally directed in the direction of travel 302 of the web 22.

Inventive air foil 306 may be hingedly mounted in papermachine region 300 as described above in connection with other embodiments. While the injection air gaps such as gaps 330 and 332 generally have a distance between surfaces or a gap opening 384 of from about 0.05 nm to about 2 mm, from about 0.1 mm to 1 mm is typical, with from about 0.25 to about 0.75 mm often being preferred. A gap opening of about 0.5 mm is believed to be particularly suitable for stabilizing a wet or moist paper web. Air is supplied to the various air manifolds, such as manifold 340 supplying air to gap 330, generally at a pressure of from about 0.1 to about 40 inches of water (positive gauge pressure) whereas preferred pressures may include from between about 0.25 to 20 inches of water or between about 0.5 to 10 inches of water in some embodiments. A manifold positive pressure supplying the gap with air of from about 2 to about 3 inches of water is believed particularly suitable.

The embodiment of FIGS. 11–14 is suitably employed in wet-crepe tissue or towel-making processes. In general, in such cases the web has a consistency (solids content) of less than about 98 percent and is stabilized over an open draw by positioning a generally planar, substantially continuous support surface provided with air injection ports over the open draw such that the web moves along the support surface as it traverses the open draw. Air is supplied to the injection ports at pressures of from 0.1 to 40 inches of water. In some wet-crepe processes, the consistency of the web may be from about 50 to about 75 percent; while in others, the consistency of the as-creped web may be from about 65 to about 85 percent. In all cases, the inventive apparatus of FIGS. 11–14 enables the subject wet-crepe process to be operated at high speeds.

Accordingly, the aforedescribed embodiments are intended for the purpose of illustration and not as limitation.

What is claimed is:

1. An apparatus for supporting a web of paper moving through a region of a papermachine in which the moving web of paper is transferred from the surface of one component of the papermachine to the surface of a subsequent component of the papermachine, the apparatus comprising:

an air-permeable sheet supportable in a stationary condition across at least a portion of a papermachine region through which a moving web of paper is transferred from one component of the papermachine to a subsequent component of the papermachine and so that as the web is moved through the papermachine region, the web moves along one side of the air-permeable sheet; and means associated with the air-permeable sheet for creating a zone of sub-atmospheric pressure on the side of the air-permeable sheet opposite the web of paper so that as the web is moved through the papermachine region, the web is biased into contact with the air-permeable sheet and moves in sliding engagement therealong.

2. The support apparatus as defined in claim 1 wherein the air-permeable sheet has a leading edge across which the moving web moves into contact with the air-permeable sheet and a trailing edge across which the moving web moves out of contact with the air-permeable sheet, and the air-permeable sheet is supportable in a stationary condition across the papermachine region so that at least one of the leading and trailing edges of the sheet is disposed in relatively close proximity to the nearest papermachine component disposed upstream or downstream of the support apparatus.

3. The support apparatus as defined in claim 2 wherein the at least one of the leading and trailing edges of the sheet is disposed within about 1.0 feet from the surface of the nearest papermachine component disposed upstream or downstream of the support apparatus when the sheet is supported in a stationary condition across the papermachine region.

4. The support apparatus as defined in claim 1 including means for moving air away from the side of the air-permeable sheet opposite the web to thereby create the zone of sub-atmospheric pressure adjacent said side of the air-permeable sheet.

5. The support apparatus as defined in claim 4 wherein the means for moving air includes a blowbox including nozzles for directing source air away from the side of the air-permeable sheet opposite the web to create the zone of sub-atmospheric pressure adjacent the side of the air-permeable sheet.

6. The support apparatus as defined in claim 5 wherein the blowbox includes walls which are joined together to provide an interior for the blowbox and a partition which is supported in a spaced relationship with said side of the air-permeable sheet and separating the blowbox interior from the air-permeable sheet, and the zone of sub-atmospheric pressure created by the blowbox nozzles is created within the space defined between said side of the air-permeable sheet and the blowbox partition.

7. The support apparatus as defined in claim 4 wherein the means for moving air includes at least one Coanda air knife for drawing air from the side of the air-permeable sheet opposite the web.

8. The support apparatus as defined in claim 7 further comprising a compartment having an interior and a panel disposed adjacent the web, and the air-permeable sheet provides said panel, and the at least one Coanda air knife is adapted to draw air out of the compartment interior so that sub-atmospheric pressure is created in the compartment interior and is thereby created on the side of the air-permeable sheet opposite the web.

9. The apparatus as defined in claim 1 further comprising means for adjusting the strength with which the moving web is biased against the air-permeable sheet.

10. The apparatus as defined in claim 9 wherein the air-permeable sheet includes a plurality of through-openings which extend between the opposite sides of the air-permeable sheet, and the adjusting means includes means for adjusting the size of a preselected number of through-openings defined in the air-permeable sheet.

11. The apparatus as defined in claim 10 wherein the adjusting means includes plate means positionable against the side of the air-permeable sheet opposite the moving web for movement relative to and across the air-permeable sheet between a condition at which the through-openings of the preselected number of through-openings are open and a condition at which the through-openings of the preselected number of through-openings are closed.

12. The apparatus as defined in claim 1 wherein one of the one component and the subsequent component of the papermachine between which the web is transferred is a cylinder and the other of the one component and the subsequent component of the papermachine between which the web is transferred is a permeable medium.

13. The apparatus as defined in claim 1 wherein the air-permeable sheet is supportable in a stationary condition along at least a portion of the side edges of the papermachine region through which a moving web of paper is transferred from one component of the papermachine to a subsequent component of the papermachine so that the means for creating the zone of sub-atmospheric pressure on the side of the air-permeable sheet opposite the web biases at least the side edges of the web into contact with the air-permeable sheet for sliding movement therealong.

14. An apparatus for supporting a web of paper moving through a region of a papermachine through which region the web is otherwise out of contact with any component of the papermachine, the apparatus comprising:

an air-permeable sheet supportable in a stationary condition across at least a portion of the papermachine region through which the moving web of paper is otherwise out of contact with any component of the papermachine and adjacent one side of the moving web so that as the web is moved through the papermachine region, the web moves along one side of the air-permeable sheet; and means associated with the air-permeable sheet for creating a zone of sub-atmospheric pressure adjacent the side of the air-permeable sheet opposite the web so that as the web is moved through the papermachine region, the web is biased into contact with the air-permeable sheet and moves in sliding engagement therewith.

15. The support apparatus as defined in claim 14 wherein the air-permeable sheet has a leading edge across which the moving web moves into contact with the air-permeable sheet and a trailing edge across which the moving web moves out of contact with the air-permeable sheet, and the air-permeable sheet is supportable in a stationary condition across the papermachine transfer region so that either the leading edge of the sheet is disposed in relatively close proximity to the surface of a papermachine component from which the moving web enters the papermachine region or the trailing edge of the sheet is disposed in relatively close proximity to the surface of a subsequent papermachine component to which the moving web exits the papermachine region.

16. The support apparatus as defined in claim 14 including means for moving air away from the side of the air-permeable sheet opposite the web to thereby create the zone of sub-atmospheric pressure adjacent said side of the air-permeable sheet.

17. The support apparatus as defined in claim 16 wherein the means for moving air includes a blowbox including nozzles for directing source air away from the side of the air-permeable sheet opposite the web to create the zone of sub-atmospheric pressure adjacent said side of the air-permeable sheet.

18. The support apparatus as defined in claim 16 wherein the means for moving air includes at least one Coanda air knife for drawing air from the side of the air-permeable sheet opposite the web.

19. A method for supporting a web of paper moving through a region of a papermachine through which region the moving web is transferred from the surface of one component of a papermachine to the surface of a subsequent component of a papermachine, the method comprising the steps of:

positioning an air-permeable sheet in a stationary condition across at least a portion of the papermachine region through which a moving web of paper is transferred from one component of the papermachine to a subsequent component of the papermachine and so that as the web is moved through the papermachine region, the web moves along one side of the air-permeable sheet; and creating a zone of sub-atmospheric pressure adjacent the side of the air-permeable sheet opposite the web so that as the web is moved through the papermachine region, the web is biased into contact with the air-permeable sheet and moves in sliding engagement therealong.

20. The method as defined in claim 19 wherein the air-permeable sheet has a leading edge across which the moving web moves into contact with the air-permeable sheet and a trailing edge across which the moving web moves out of contact with the air-permeable sheet, and the step of positioning the air-permeable sheet in a stationary condition across the papermachine transfer region positions either the leading edge of the sheet in relatively close proximity to the surface of the one papermachine component from which the moving web is being transferred or the trailing edge of the sheet in relatively close proximity to the surface of the subsequent papermachine component to which the moving web is being transferred.

21. The method as defined in claim 19 wherein the step of creating is effected with a blowbox including nozzles for directing source air away from the side of the air-permeable sheet opposite the web to create a zone of sub-atmospheric pressure adjacent said side of the air-permeable sheet.

22. The method as defined in claim 19 wherein the step of creating is effected with at least one Coanda air knife which draws air away from the side of the air-permeable sheet opposite the web to create a zone of sub-atmospheric pressure adjacent said side of the air-permeable sheet.

23. The method as defined in claim 19 wherein the step of creating is followed by a step of adjusting the strength with which the moving web is biased against the air-permeable sheet.

24. An apparatus for supporting a web of paper moving through a region of a papermaking machine in which the moving web is transferred from the surface of one component of the papermachine to the surface of a subsequent component of the papermachine, the apparatus comprising:

a multiplicity of overlapping plates supportable in a stationary condition across at least a portion of a papermaking region through which a moving web of paper is transferred from one component of the papermachine to a subsequent component of the papermachine so that as the web is moved through the papermaking region, the web moves along a support surface defined generally by said multiplicity of overlapping plates;

means associated with the multiplicity of overlapping plates for maintaining injection air gaps between successive overlapping plates whereby the gap can be controlled to have a gap opening of between about 0.05 mm and 2 mm; and means associated with the multiplicity of overlapping plates for supplying injection air to the injection air gaps at an air gauge pressure of from about 0.1 inches to about 40 inches of water and passing the injection air through the injection gaps in the direction of movement of said web.

25. The support apparatus as defined in claim 24 wherein said injection air gaps are controlled to have a gap opening of between about 0.1 mm to about 1 mm.

26. The support apparatus as defined in claim 25 wherein said injection air gaps are controlled to have a gap opening of between about 0.25 mm to about 0.75 mm.

27. The support apparatus as defined in claim 26 wherein said injection air gaps are controlled to have a gap opening of about 0.5 mm.

28. The support apparatus as defined in claim 24 wherein injection air is supplied to said injection air gaps at an air gauge pressure of from about 0.25 inches of water to about 20 inches of water.

29. The support apparatus as defined in claim 28 wherein injection air is supplied to said injection air gaps at an air gauge pressure of from about 0.5 inches of water to about 10 inches of water.

30. The support apparatus as defined in claim 29 wherein injection air is supplied to said injection air gaps at an air gauge pressure of from about 2 to about 3 inches of water.

31. The support apparatus as defined in claim 24 further comprising a plurality of independently adjustable manifolds for supplying air to said injection air gaps.

32. The support apparatus as defined in claim 24 wherein said support surface is a stepped support surface.

33. A method for supporting a web of paper having a consistency of less than about 98 percent moving through a region of a papermachine through which region the moving web is transferred from the surface of one component of a papermachine to the surface of a subsequent component of a papermachine, the method comprising the steps of:

positioning a support surface defined by a multiplicity of plates in a stationary condition across at least a portion of the papermachine region through which a moving web of paper is transferred from one component of the papermachine to a subsequent component of the papermachine such that as the web is moved through the papermachine region, the web moves along said support surface defined by said multiplicity of plates;

said multiplicity of plates defining a plurality of injection air gaps provided with an opening;

maintaining the gap opening of said injection air gaps to be from about 0.05 mm to about 2 mm; and supplying injection air to said injection air gaps at a pressure of from about 0.1 inches of water to about 40 inches of water.

34. The method as defined in claim 33 wherein said web is of a consistency of from about 50 percent to about 75 percent.

35. The method as defined in claim 33 wherein said web is of a consistency of from about 65 to about 85 percent.

36. The method as defined in claim 33 wherein the gap opening of said injection air gaps is maintained to be between about 0.1 mm and 1 mm.

37. The method as defined in claim 36 wherein the gap opening of said injection air gaps is maintained to be between about 0.25 mm and 0.75 mm.

38. The method as defined in claim 37 wherein the gap opening of said injection air gaps is maintained at about 0.5 mm.

39. The method as defined in claim 33 wherein said injection air is supplied to said injection air gaps at an air gauge pressure of from about 0.25 inches of water to about 20 inches of water.

40. The method as defined in claim 39 wherein said injection air is supplied to said injection air gaps at an air gauge pressure of from about 0.5 inches of water to about 10 inches of water.

41. The method as defined in claim 40 wherein said injection air is supplied to said injection air gaps at an air gauge pressure of from about 2 to about 3 inches of water.

42. The method as defined in claim 33 wherein said support surface is a stepped support surface defined by a multiplicity of overlapping plates defining said injection air gaps therebetween.

43. A method for supporting a web of paper having a consistency of less than about 98 percent moving through a region of a papermachine through which region the moving web is transferred from the surface of one component of a papermachine to the surface of a subsequent component of a papermachine, the method comprising the steps of:

positioning a generally planar support surface defining a plurality of air injection ports in a stationary condition across at least a portion of the papermachine region through which a moving web of paper is transferred from one component of the papermachine to a subsequent component of the papermachine such that as the web is moved through the papermachine region, the web moves along said support surface;

maintaining the opening of each port of the air injection ports within about 0.05 mm and 2 mm as measured along the direction of web travel; and supplying injection air to said injection ports at a pressure of from about 0.1 inches of water to about 40 inches of water.

44. The method as defined in claim 43 wherein said web is of a consistency of from about 50 to about 75 percent.

45. The method as defined in claim 43 wherein said web is of a consistency of from about 65 to about 85 percent.

46. The method as defined in claim 43 wherein said injection air is supplied to said injection air gaps at an air gauge pressure of from about 0.25 inches of water to about 20 inches of water.

47. The method as defined in claim 46 wherein said injection air is supplied to said injection air gaps at an air gauge pressure of from about 0.5 inches of water to about 10 inches of water.

48. The method as defined in claim 47 wherein said injection air is supplied to said injection air gaps at an air pressure of from about 2 to about 3 inches of water.

* * * * *